US006708624B2

(12) United States Patent
Faryniak et al.

(10) Patent No.: US 6,708,624 B2
(45) Date of Patent: Mar. 23, 2004

(54) SIDE BEARING WITH MULTI-PURPOSE MOUNTING POINTS

(75) Inventors: John G. Faryniak, Pittsburgh, PA (US); Bruce Gatnarek, Allison Park, PA (US); Aubra D. McKisic, Baden, PA (US)

(73) Assignee: Hansen, Inc., Pittsburgh, PA (US)

( * ) Notice: Subject to any disclaimer, the term of this patent is extended or adjusted under 35 U.S.C. 154(b) by 361 days.

(21) Appl. No.: 10/166,335

(22) Filed: Jul. 19, 2001

(65) Prior Publication Data

US 2003/0106456 A1 Jun. 12, 2003

(51) Int. Cl.[7] ..... B61F 5/00

(52) U.S. Cl. ..... 105/218.2; 105/199.3

(58) Field of Search ..... 105/199.3, 199.4, 105/218.2, 4.1; 384/423; 267/3, 141.2; 248/635; 280/716; 29/898.09, 896.93, 446; 264/294

(56) References Cited

U.S. PATENT DOCUMENTS

| | | | | | |
|---|---|---|---|---|---|
| 979,120 | A | | 12/1910 | Woods | |
| 1,728,336 | A | * | 9/1929 | Downey | 384/423 |
| 2,394,158 | A | * | 2/1946 | Ellis et al. | 384/423 |
| 2,674,449 | A | * | 4/1954 | Tucker | 267/3 |
| 2,821,380 | A | * | 1/1958 | Strandberg | 267/2 |
| 3,295,463 | A | | 1/1967 | Barber | |
| 3,957,318 | A | | 5/1976 | Wiebe | |
| 4,080,016 | A | | 3/1978 | Wiebe | |
| 4,245,564 | A | * | 1/1981 | Eulenfeld | 105/199.4 |
| 4,323,015 | A | | 4/1982 | Hess et al. | |
| 4,408,810 | A | | 10/1983 | Geyer | |
| 4,712,487 | A | | 12/1987 | Carlson | |
| 4,998,997 | A | * | 3/1991 | Carlston | 267/3 |
| 5,207,161 | A | | 5/1993 | Pileggi et al. | |
| 5,386,783 | A | | 2/1995 | Rhen et al. | |
| 5,401,008 | A | * | 3/1995 | Winkler et al. | 267/140.13 |
| 5,454,330 | A | * | 10/1995 | Rhen | 105/199.3 |
| 5,601,031 | A | * | 2/1997 | Carlson | 105/199.3 |
| 6,092,470 | A | | 7/2000 | O'Donnell | |

* cited by examiner

*Primary Examiner*—S. Joseph Morano
*Assistant Examiner*—Frantz F. Jules
(74) *Attorney, Agent, or Firm*—Buchanan Ingersoll, P.C.

(57) ABSTRACT

A railway truck side bearing with multi-purpose mounting points for securing the bearing cage to a railway truck bolster, such that one of the mounting points can serve a dual function of locating a resiliently deformable bearing element in the bearing cage and permitting positioning of a rigid bearing element within the bearing cage midway between the mounting points, which may also correspond to the bolster centerline.

9 Claims, 2 Drawing Sheets

SIDE BEARING WITH MULTI-PURPOSE MOUNTING POINTS

BACKGROUND

This invention pertains to side bearings for a railway truck such as the well known three piece truck as commonly used in freight service.

Typically, a rail car body is rotatably supported at its opposite ends on the center bowls of respective truck bolsters. Each such bolster extends transversely of the track and is supported at its opposed longitudinal ends by springs carried by the respective truck side frames.

A railway truck bolster commonly carries a pair of side bearings which are spaced from the bolster center bowl toward the respective longitudinal ends of the bolster, and are secured thereto by mechanical fasteners such as bolts. Each side bearing engages a wear plate mounted on the car body to support the car body laterally outward of the bolster center bowl and thereby limit lateral car body rocking.

Certain types of side bearings, known as constant contact side bearings, are installed in a preloaded state to maintain continuous forceful engagement with the car body wear plate. A constant contact side bearing slides on the car body wear plate in operation to thereby provide frictional energy dissipation and assist in controlling the destructive, cyclic truck motion known as hunting. As the hunting phenomenon is well known and is discussed at length in the prior art, detailed description thereof is unnecessary here. Suffice it to note that in many known side bearings, the normal force for frictional energy dissipation is provided by resilient deformation of coil springs or other compliant elements such as elastomeric columns. The prior art of side bearings with resiliently deformable bearing elements includes those disclosed in, for example, U.S. Pat. Nos. 3,295,463, 3,957,318, 4,080,016, 4,712,487, 4,998,997, 5,207,161, 5,386,783, and 5,601,031.

SUMMARY

The present invention contemplates a side bearing wherein a side bearing cage is provided with through openings in the cage base to accommodate fasteners, for securing the cage to a railway truck bolster. One such opening can be provided in a cavity in the cage which houses an upstanding elastomeric column, or similar resiliently deformable bearing element. Such opening can be generally coaxial the center of the bearing cavity. Additionally, such opening can extend through an upwardly projecting boss located centrally in the base of the side bearing cage such that the boss can serve to locate and/or retain a lower end of the upstanding elastomeric column. Alternatively, the head of a fastener used to secure the bearing cage to the bolster via the opening can locate and/or retain the end of the bearing column.

The elastomeric bearing element can similarly be located and retained at its upper end by a cap member which engages the side bearing cage so that transverse loadings generally pass to the bolster from the cap member through the side bearing cage and are generally not carried by the elastomeric bearing element.

The structural configuration of the side bearing cage also permits mounting on a bolster such that a solid or rigid bearing element housed in the bearing cage, a roller for example, can be located near the midpoint of the bearing cage mounting points on the bolster, and thus typically the bolster centerline, which can be a useful feature in view of benefits related to symmetrical bearing loading.

These and other advantages of the invention will be more readily appreciated upon consideration of the following detailed description, and the accompanying drawings which are briefly described immediately below.

BRIEF DESCRIPTION OF THE DRAWING FIGURES

DETAILED DESCRIPTION OF CERTAIN EMBODIMENTS

Figure 1:
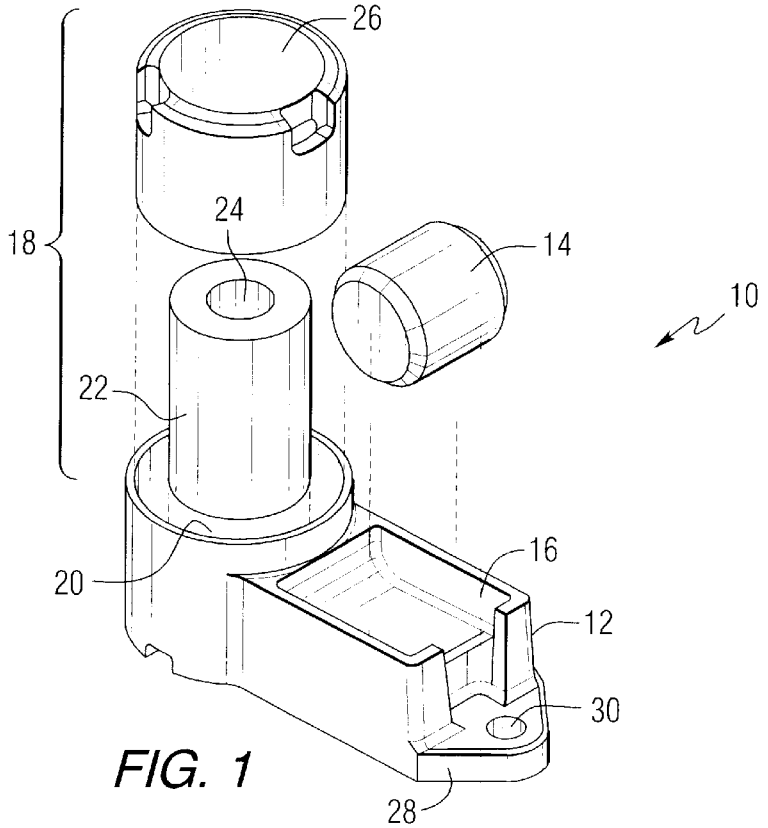
FIG. 1 is an exploded perspective view of a side bearing according to one presently preferred embodiment of the invention.

There is generally indicated at 10 in FIG. 1 a railway truck side bearing according to one presently preferred embodiment of the instant invention. Side bearing 10 includes a rigid base or cage 12, for example a rigid metal casting or an assembly of cast and/or fabricated components, a rigid bearing element 14 such as a roller that is disposed in a first bearing cavity portion 16 of cage 12, and a compliant bearing assembly 18 that is disposed in a second bearing cavity portion 20 of cage 12. For the side bearing shown, the compliant bearing assembly 18 is comprised of an elongated, generally cylindrical, resiliently deformable element 22 having an axial through opening 24, and a rigid cap 26. Element 22 may be formed from any suitable elastomer, polyurethane for example.

As is known, a standard truck bolster may include two pairs of side bearing mounting holes, each pair being located generally symmetrically with respect to the bolster centerline and spaced 8½ inches apart on centers. Thus, the side bearing cage 12 can have a pair of corresponding mounting points for attachment thereof to the bolster. In FIG. 1, only one such mounting point is shown. Thus, a lug 28 extends from one end of cage 12 adjacent its lower extremity, and a hole 30 extends vertically through lug 28 to receive a bolt or other suitable fastener. Cage 12 includes a second such mounting hole 58 (FIG. 3) which is, in a typical application, spaced about 8½ inches from hole 30 to receive a second mounting bolt or other suitable fastener.

Figure 2:
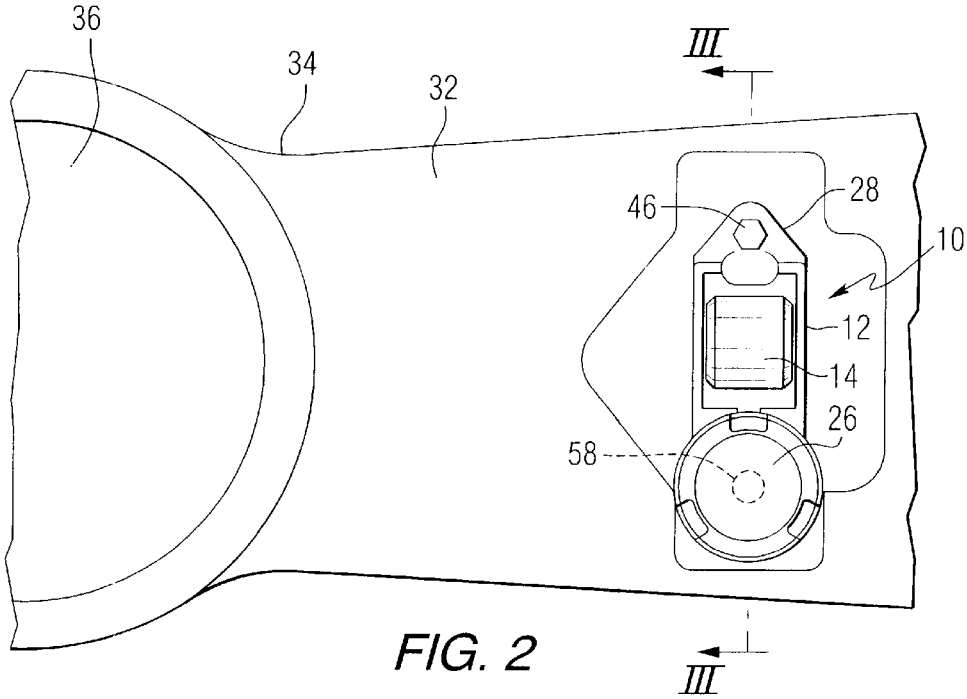
FIG. 2 is a top plan view of the side bearing of FIG. 1 installed on a railway truck bolster, shown in fragmentary part.
Figure 3:
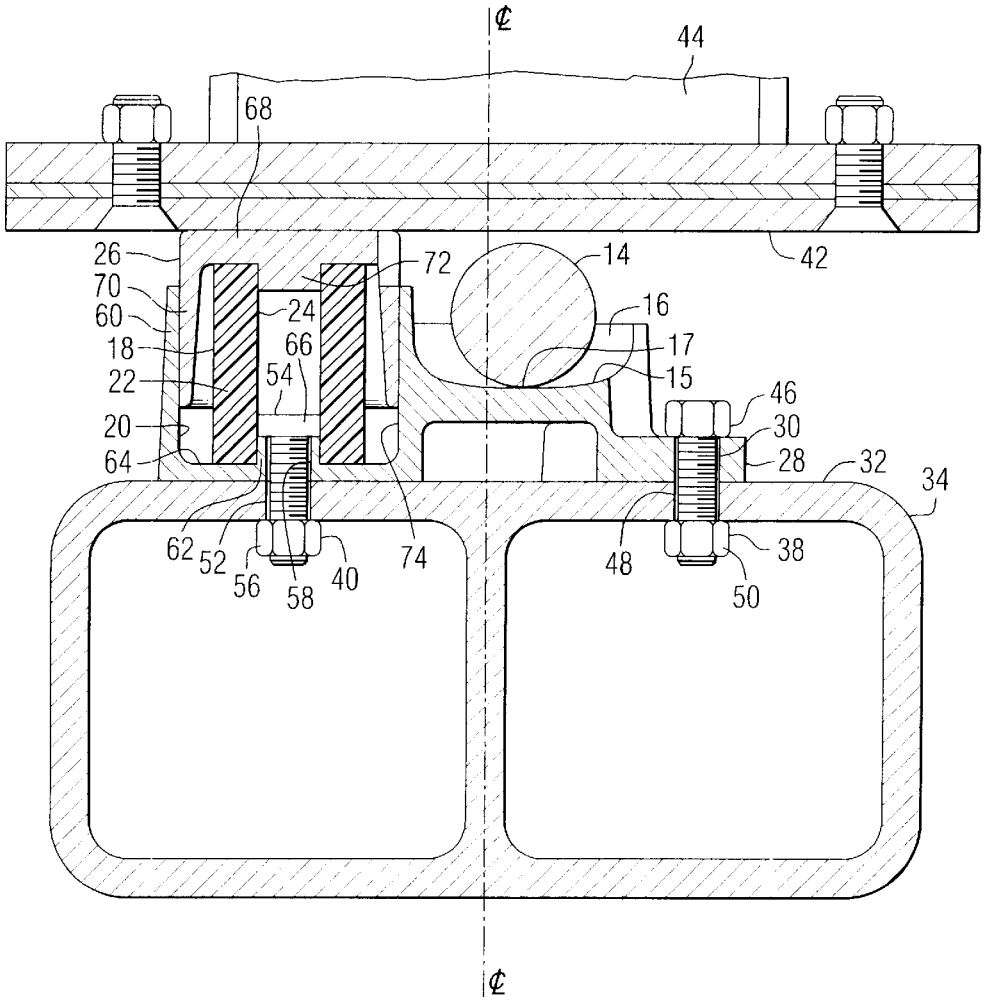
FIG. 3 is an enlarged sectional view taken on line III—III of FIG. 2.

As shown in FIGS. 2 and 3, the upper surface 32 of a railway truck bolster 34 carries the side bearing 10 at a location spaced longitudinally of the bolster from the center bowl 36. Thus, bolster surface 32 is provided with a two pairs of side bearing mounting holes, each pair being located generally symmetrically with respect to the bolster centerline, and commonly about 25 inches from the center of the bolster center bowl 36. However, it is known that some bolsters can be provided with mounting pads (not shown), to which the side bearing cages 12 are attached, wherein the mounting pads are offset from the centerline of the bolster. In any case, each side bearing 10 is secured to upper surface 32 of the bolster, via the described mounting holes, by fastener assemblies 38 and 40 (FIG. 3), each comprising, for example, a nut and a bolt, although other fasteners, including non-threaded fasteners could be used. When thus secured to bolster 34, side bearing 10 can engage a wear plate 42, or other surface, of a car body 44 in frictional sliding engagement (FIG. 3) to thereby dissipate energy and assist in the control of hunting responses.

Fastener assembly 38 typically comprises a bolt 46 which passes through hole 30 in side bearing lug 28, thence through a mutually aligned mounting hole 48 in bolster 34, and can be secured by a nut 50. As noted above, in accord with standard railway truck construction, bolster 34 includes a second through hole 52 for securing side bearing 10, and the side bearing 10 includes a corresponding hole 58 located centrally in the bearing element cavity portion 20 of cage 12. Hence, holes 52 and 58 are aligned to receive the fastener assembly 40 identified hereinabove, which may comprise a bolt 54 and a nut 56, for securing side bearing 10 to bolster surface 32.

Bearing element cavity portion 20 can include a generally cylindrical, upstanding sidewall portion 60 which confines elastomeric element 22 and cap 26. In one presently preferred embodiment, a generally cylindrical, upstanding boss 62 projects upwardly from the base or floor 64 of cavity 20 and generally coaxially with respect to cylindrical sidewall 60. Hole 58 extends coaxially within boss 62 and thus is coaxially disposed with respect to both sidewall 60 and boss 62. When bolt 54 is installed in hole 58, the head 66 of bolt 54 is retained atop boss 62 as shown.

As noted, elastomeric element 22 is comprised of a generally cylindrical, upstanding column having a coaxial through opening 24 whereby the lower end of elastomeric bearing element 22 fits over and surrounds boss 62 and bolt head 66, and rests upon cavity floor 64. It should be understood that the elastomeric element can also have a shape other than cylindrical. To accommodate such assembly, the bolt head 66 may be of any suitable geometry, although a conventional hex bolt certainly may be suitable, consistent with the requirements of convenient installation, retention, and removal of the side bearing on bolster 34.

It will be further noted that although the cylindrical through opening 24 may be preferred in elastomeric element 22, a suitable alternative not shown herein may be a blind opening extending coaxially from the lower end of elastomeric element 22 only so far as necessary to accommodate boss 62 and bolt head 66 in all anticipated modes of elastomeric element deformation. Also, the through opening 24 or blind hole may have a shape other than cylindrical. The geometric variation in the elastomeric column 22 may be limited by the resilient deformation requirements and properties necessary for proper functioning of the side bearing.

The provision of the hole 58, and boss 62, centrally within the elastomeric bearing cavity 20 and generally coaxial with the mounting hole 52 in the bolster can provide certain benefits. For example, it permits the bearing cage 12 to be mounted on the bolster 34 such that the rigid bearing member 14 is generally centered between the bearing cage 12 mounting holes 30 and 58, which also typically corresponds to the centerline of the bolster—midway between the bolster 34 mounting holes 48 and 52. This can be advantageous in view of the benefits related to symmetrical bearing loading. Additionally, the described structure serves to locate and/or retain the lower end of the elastomeric element 22 in spaced relationship with respect to the surrounding sidewall portion 60 of the elastomeric bearing cavity 20. Alternatively, in this regard, it must also be understood that the boss 62 need not be provided, and the head of the bolt 54 can itself locate and/or retain the lower end of the elastomeric element 22. Alternatively, it should be understood that neither a boss nor a protruding bolt head would necessarily be required, since the bottom of the elastomeric bearing cavity 20 could be configured, such as with a recessed portion or raised rib to locate and/or retain the lower end of the elastomeric element 22. The recessed portion or raised rib could locate the lower end of the elastomeric 22 by cooperating either with the outer perimeter of the elastomeric element 22 or the blind/through hole.

Bearing cap 26 provides a corresponding locating and retaining function for the upper end of elastomeric element 22. Accordingly, the cap 26 comprises a rigid, preferably unitary member having a top portion 68, which may be generally circular, having an elongated peripheral skirt portion 70, which also may be generally cylindrical, depending axially therefrom. A boss portion 72, which may correspondingly be generally cylindrical, of the top portion 68 can extend coaxially with respect to skirt portion 70 sufficiently to provide a locating and retention element similar in function to boss 62 and bolt head 66. Accordingly, boss 72 extends into the upper open end of through opening 24 in elastomeric element 22 (or alternatively, into an axial blind hole of suitable length) to thereby locate and retain the upper end of elastomeric element in a centered position with respect to cap 26.

Skirt portion 70 is of an outside diameter to provide a close sliding fit with the adjacent, inner cylindrical surface 74 of cage sidewall portion 60, and their mutually engaged cylindrical surfaces are suitably finished to accommodate such sliding. Moreover, the inside diameter of both sidewall portion 60 and skirt 70 is sufficiently larger than the outside diameter of elastomeric element 22 to maintain the element 22 in radially spaced relationship with respect to both, whereby elastomeric element 22 is isolated from transverse loading evolved by the frictional sliding engagement between the side bearing 10 and the wear plate 42 in operation.

More specifically, with skirt 70 in close sliding fit within sidewall portion 60, transverse forces imposed on cap 26 during frictional sliding on wear plate 42 are carried via skirt 70 to sidewall 60, and thence via bearing cage 12 and fastener sets 38 and 40 to bolster 34. The elastomeric element 22 is thus isolated from such forces.

Bearing element cavity portion 16 is disposed adjacent to bearing cavity portion 20, as shown in FIG. 3, and roller 14 is disposed therein. The cavity portion 16 includes a sloping surface 15 on which roller 14 is supported, and which slopes downwardly from its opposed ends to a low area 17 located generally centrally intermediate the opposed ends of surface 15.

Roller 14 acts as a solid stop to limit vertically downward displacement of cap 26, and hence to also limit vertical, compressive deformation of elastomeric column 22. The resulting limitation on the normal force between cap 26 and wear plate 42 serves to establish a maximum frictional force that can be evolved therebetween, and hence ensures that the frictional restraint opposing truck rotation or yaw with respect to the car body will not exceed a predetermined maximum restraint.

Roller 14 rolls freely on surface 15, and when not otherwise restrained, gravity causes it to come to rest at low area 17. Due to the mechanical configuration of bearing cage 12, and the scheme for attachment thereof to bolster 34 as described, the low area 17 may be located very close to the bolster centerline, and in any event closer thereto than other bearing elements in the assembly. This can be a preferred location for roller 14 in view of the benefits of bearing load symmetry. While the invention has been shown with a rigid bearing, such as a roller 14, other embodiments without a rigid bearing may also be used.

According to the description hereinabove, we have invented a novel and improved side bearing for use on a railway truck. Of course, we have contemplated various modified and alternative embodiments of our invention, and certainly such would occur to others versed in the art once they were apprised of the invention. Accordingly, it is our intention that the invention should be construed broadly.

What is claimed is:

1. A railway vehicle side bearing adapted to be secured to a railway truck member for load bearing engagement with a railway car body wear plate, said side bearing comprising:

a. a rigid housing having at least a first bearing cavity, said first bearing cavity having a base;

b. a resiliently deformable bearing element disposed in said first bearing cavity with a lower end thereof supported on said base;

c. said base having a first hole therethrough to secure said rigid housing to said railway truck member, said first hole located centrally in said first bearing cavity; and d. said lower end of said resiliently deformable bearing element centrally located in said first bearing cavity by at least one of a raised portion of said base and a portion of a fastener disposed through said first hole.

2. The railway vehicle side bearing of claim 1 wherein said raised portion further comprises an upstanding boss and said first hole extending generally coaxially through said upstanding boss.

3. The railway vehicle side bearing of claim 1 further comprising:

a. said rigid housing having a second bearing cavity;

b. a rigid bearing element disposed in said second bearing cavity;

c. a mounting portion and a second hole through mounting portion to secure said rigid housing; and d. said second hole being spaced from said first hole such that said rigid bearing element is located generally midway between said first and second holes.

4. The railway vehicle side bearing of claim 3 wherein a midpoint between said first and second holes generally corresponds to a centerline of said bolster.

5. The railway vehicle side bearing of claim 1 further comprising:

a. a wear cap having a top portion and a downwardly depending portion extending from said top portion and surrounding an upper end of said resiliently deformable bearing element;

b. said top portion having an outer surface adapted to engage said car body wear plate; and c. said first cavity having an upwardly projecting portion configured to cooperate with said downwardly depending portion such that transverse loadings from engagement of said outer surface with said car body wear plate are transferred to said bolster via engagement of said downwardly depending portion with said upwardly projecting portion.

6. The railway vehicle side bearing of claim 5 further comprising:

a. said top portion having an inner surface abutting said upper end of said resiliently deformable bearing element; and b. said inner surface configured to engage said upper end of said resiliently deformable bearing element to locate said upper end in said second cavity.

7. The railway vehicle side bearing of claim 6 further comprising said resilient bearing element having at least one of a blind hole at each of said upper and lower ends thereof and a through hole, by which said lower and upper ends thereof are located in said first cavity.

8. The railway vehicle side bearing of claim 7 further comprising said inner surface of said top portion having a downwardly extending portion which engages said upper end of said resiliently deformable bearing element via one of said blind hole and said through hole.

9. The railway vehicle side bearing of claim 8 further comprising said first cavity and said resiliently deformable bearing element being generally cylindrical shaped.

* * * * *